US006000175A

United States Patent [19]

Gale et al.

[11] Patent Number: 6,000,175

[45] Date of Patent: Dec. 14, 1999

[54] PORTABLE PROTECTIVE STRUCTURE

[75] Inventors: Harry Gale, *deceased, late of* Toorak, *by* Gary Gale, *executrix*; Peter R. McDonald, Aspendale, both of Australia

[73] Assignee: Gale Australia Pty, Ltd.

[21] Appl. No.: 08/908,763

[22] Filed: Aug. 8, 1997

Related U.S. Application Data

[60] Provisional application No. 60/024,165, Aug. 9, 1996.

[51] Int. Cl.[6] ..... E04H 15/44; E04B 1/343

[52] U.S. Cl. ..... 52/63; 52/79.5; 52/653.7; 52/655.1; 52/646; 52/741.1; 135/127; 135/122; 135/141; 135/147; 135/160

[58] Field of Search ..... 135/127, 143, 135/147, 145, 142, 135, 158, 156, 157, 159, 130, 131, 138, 144, 909; 52/63, 646; 403/170, 171, 176, 169, 217, 218, 219, 328, 327, 326, 109.3, 116

[56] References Cited

U.S. PATENT DOCUMENTS

| | | | |
|---|---|---|---|
| 2,935,074 | 5/1960 | Baker | 135/142 X |
| 3,145,406 | 8/1964 | Lay | 403/326 X |
| 3,448,748 | 6/1969 | Walrave | 135/137 |
| 3,499,457 | 3/1970 | Waring et al. | 135/137 |
| 3,669,463 | 6/1972 | Boudreau | 403/109.3 X |
| 4,941,500 | 7/1990 | Emard | 135/141 |
| 4,974,884 | 12/1990 | Lynch | 135/97 |
| 5,255,698 | 10/1993 | Riley | 135/103 |
| 5,593,122 | 1/1997 | Robertson et al. | 248/222.12 |
| 5,640,811 | 6/1997 | Boyle et al. | 52/86 |
| 5,779,386 | 7/1998 | Eichhorn | 403/329 |
| 5,797,412 | 8/1998 | Carter | 135/145 |

*Primary Examiner*—Robert Canfield
*Attorney, Agent, or Firm*—Connolly & Hutz

[57] ABSTRACT

A portable protective structure includes a framework made of corner connectors and various poles, such as vertical supports, horizontal supports and roof supports. Certain of the support poles may be made of telescopic tubes of circular cross-section joined together by spring locks in the inner tube projecting into arcuate slots in the outer tube. Pairs of poles, such as horizontal poles, may be connected to a corner connector by the use of a resilient cord extending through the connector with a spring clip on each end of the cord inserted into the horizontal pole. The roof may include a peak having four sets of extending walls into which each roof pole or eave may be connected with the opposite end of each roof pole inserted into a corner connector.

28 Claims, 5 Drawing Sheets

PORTABLE PROTECTIVE STRUCTURE

CROSS-REFERENCE TO RELATED APPLICATION

This application is based on provisional U.S. application Ser. No. 60/024,165, filed Aug. 9, 1996.

BACKGROUND OF THE INVENTION

Various types of portable protective structures are known which generally include a framework made of vertical support poles mounted on the ground and secured at their upper ends to horizontal support poles. Roof poles are generally secured to the corners or intersections of the vertical and horizontal poles. The framework and particularly the roof is covered with a suitable cover material, such as canvas. Where the structure is used as a tent the cover would also extend generally to the ground.

SUMMARY OF THE INVENTION

An object of this invention is to provide a portable protective structure which may easily be assembled.

A further object of this invention is to provide such a portable protective structure which includes spring fasteners to facilitate the engagement of various pole components.

In accordance with this invention the framework includes a vertical or generally vertical support pole assembly at each corner mounted to a corner connector. A pair of horizontal support pole assemblies are mounted to each corner connector and roof poles are also mounted to each corner connector. Each vertical pole may be in the form of a pair of telescopic tubes. The inner tube would include a double pop or spring button resiliently urged outwardly for engagement with a suitably located hole in the outer tube. The hole is actually in the form of a plurality, such as three, elongated slots thereby permitting the tube structure to be of circular cross-section while assuring ready engagement of at least one and usually both of the pop buttons into one or two slots without having to pre-align the tubes. The horizontal supports may be mounted to the corner connector by inserting a resilient cord such as a bungie cord through the corner connector which each free end of the cord having a spring clip which is inserted into the horizontal pole. The resiliency of the cord tends to pull the components together.

THE DRAWINGS

DETAILED DESCRIPTION

Figure 1:
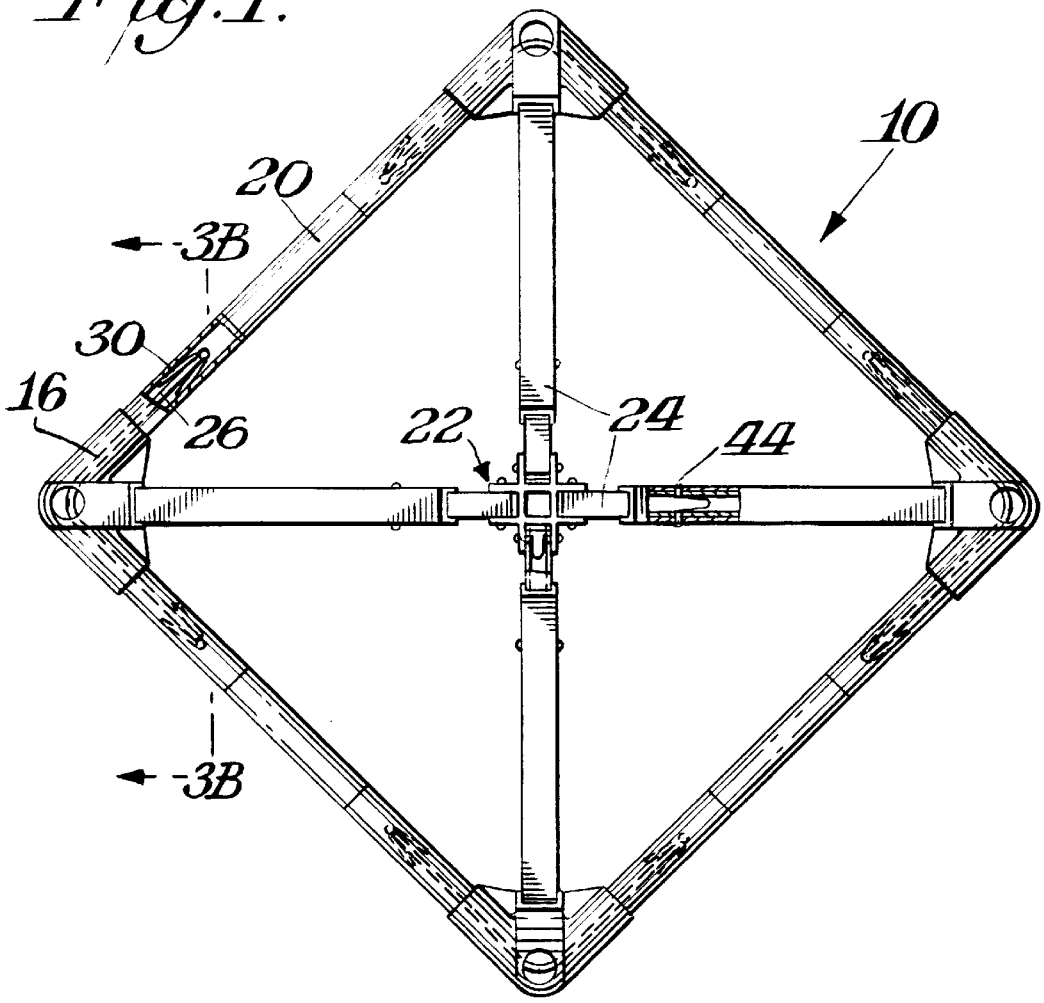
FIG. 1 is a top plan view of a portable protective structure in accordance with one embodiment of this invention.
Figure 2:
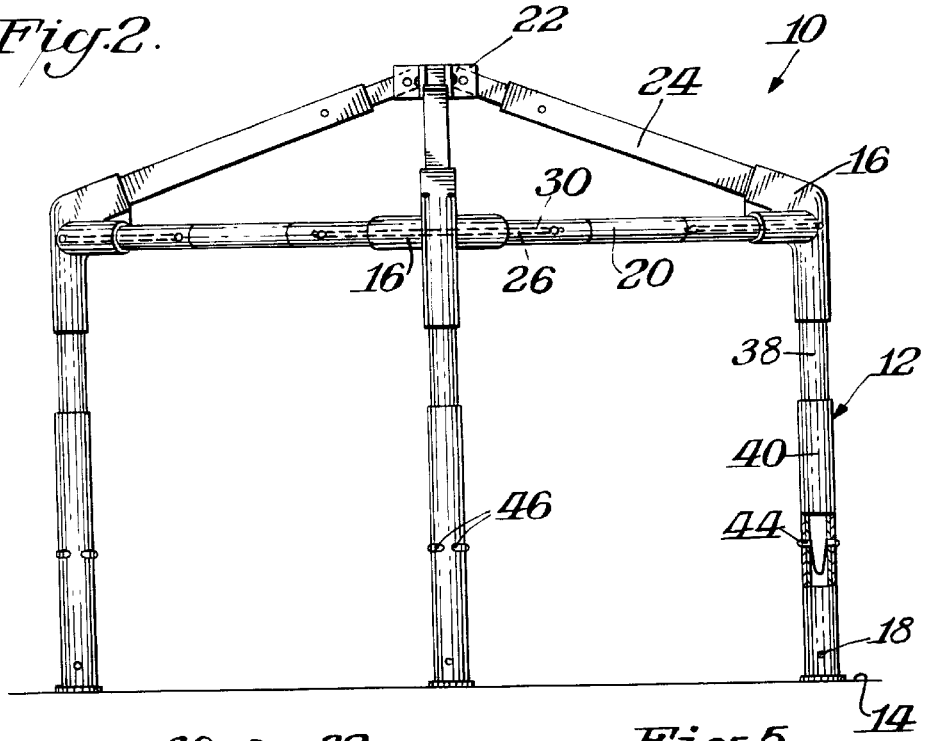
FIG. 2 is a side elevational view of the structure shown FIG. 1.

FIGS. 1–2 illustrate a portable protective structure 10 in accordance with this invention. As shown therein, structure 10 includes a vertical support pole 12 at each corner. The lower end of pole 12 is mounted on the ground 14 and the upper end is inserted into a corner connector 16. Vertical pole 12 may include a hole 18 for a wire stake loop.

The framework of structure 10 also includes four horizontal support poles 20 with an end of each pole 20 mounted in a respective corner connector 16. A suitable cover (not shown) would be mounted over the cover structure in a known manner.

The roof includes a roof peak 22 to which four eave or roof support poles 24 are mounted with each roof support pole being inserted into a corner connector 16.

Figure 3A:
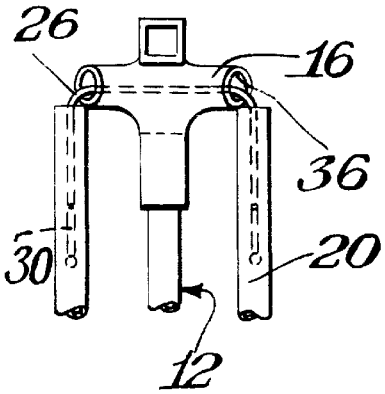
FIG. 3A is a fragmental side elevational view showing the fastening structure for one of the corner connectors.
Figure 3B:
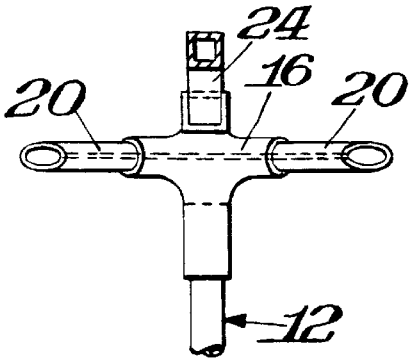
FIG. 3B is a cross-sectional view taken through FIG. 1 along the line 3B,3B.
Figure 4:
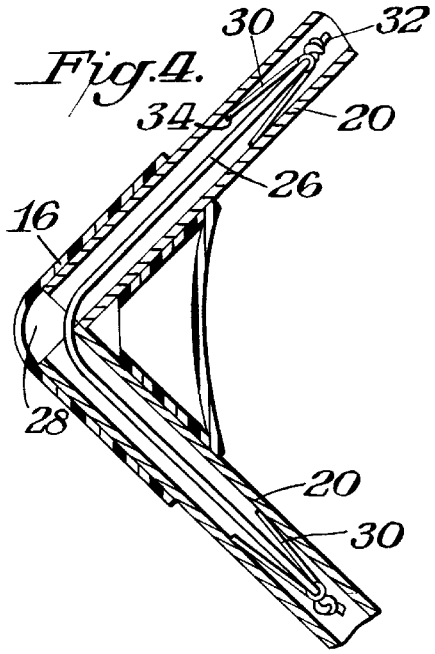
FIG. 4 is a fragmental cross-sectional view showing the mounting of the horizontal poles to the corner connector.

FIGS. 3A, 3B and 4 illustrate a manner of connecting horizontal support poles 20. As shown therein, the fastening system includes a resilient cord 26 such as a bungie cord which is inserted through a hole or passageway 28 of corner connector 16 so that each free end 32 of cord 26 extends outwardly of the corner connector 16. A spring clip 30 is secured to each free end of cord 26 with the free end 32 then being knotted to maintain the spring clip engaged with cord 26. The outer ends 34 of a respective spring clip would be squeezed together to permit the clip to be inserted into the end of pole 20 a sufficient distance such as four inches for a 1⅛ inch diameter pole. Cord 26 could be in a stretched or taut condition as shown in FIG. 3A to permit the respective ends of poles 20 to then be inserted into the appropriate hole or opening 36 of corner connector 16 with the tautness or resiliency of cord 26 urging each pole 20 to remain firmly seated in corner connector 16.

Each vertical pole 12 comprises an inner tubular member 38 telescoped into corner connector 16 and also telescoped into outer tubular member 40. Inner tubular member 38 is connected to outer tubular member 40 by a fastening system which represents a distinct improvement over the prior art. As shown, for example, in FIG. 6 inner tubular member 38 has a spring fastener 42 in the form of a resilient U-shaped arm having a button or projection 44 at each end. Fastener 42 is inserted into inner tubular member 38 with the buttons 44 extending through a pair of appropriately placed diametrically opposite holes. Outer tube 40 is locked to inner tube 38 by the mounting of at least one button 44 into a hole in outer tube 40. In accordance with this invention the hole actually comprises a plurality and preferably three elongated circumferentially aligned slots 46. Thus, when tubes 38,40 are moved with respect to each other at least one pop button and usually both pop buttons 44 will catch and lock in one or two of the slots 46. This represents a distinct advantage over the prior art in that it permits the use of tubular members having a circular cross-section without requiring any special means to align the pop buttons with holes. This also is distinctly advantageous over the prior art which used square or other non-circular cross-sections in order to achieve alignment of the pop buttons and holes. The use of tubular members of circular cross-section provides commercial advantages in being less costly to manufacture.

Figure 5:
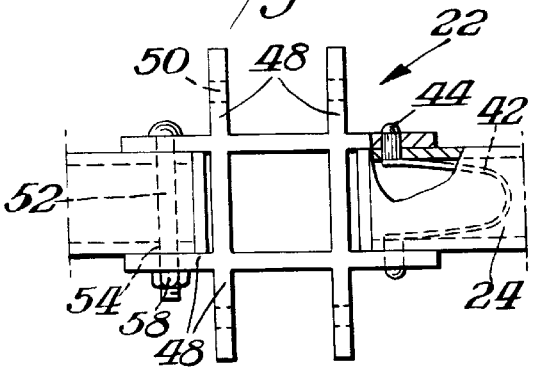
FIG. 5 is a fragmental top plan view showing the mounting of eave or roof poles to the roof peak of the structure shown in FIGS. 1–2.
Figure 8:
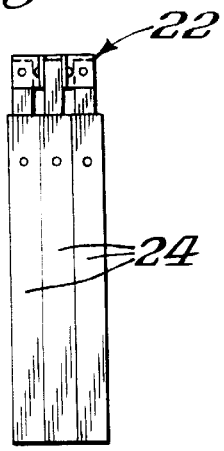
FIG. 8 is a side elevational view showing the eave or roof poles mounted to the roof peak in a pre-assembly condition.

FIG. 5 shows the details of mounting the roof supports 24 to center roof peak 22. Preferably a form of mounting is used which provides a free swinging connection of each eave or pole 24 to roof peak 22. FIG. 5 illustrates two alternative manners of accomplishing such mounting. As shown therein, center peak 22 includes four sets of extensions, each of which is a socket which comprises a pair of parallel walls 48 having sets of aligned holes 50. One manner of mounting the roof poles 24 would be through the use of spring fasteners 42 having pop buttons 44 which extend through the holes 50. Another manner would be to use small bolts 52 extending through aligned openings 54 in roof poles 24 and then through aligned holes 50 with nuts or other fasteners 58 at each end of the bolt. Instead of bolts other shafts, such as rivots, rods/cotter pins, etc. may be used. Such manner of securing the roof poles 24 to center peak 22 is user friendly in that it provides for free rotation of each pole 24 with respect to the center peak. Thus, for example, as shown in FIG. 8 the four roof poles 24 could be mounted to center piece 22 and because of the free rotation all of the poles would be able to extend in the same direction for later spreading and telescopic securement into the four corner connectors 16.

The various poles may be connected in any suitable manner. For example, a subassembly of the roof peak 22 and roof poles 24 may be preassembled as shown in FIG. 8. A subassembly of each corner piece 16 with horizontal poles 20 and vertical pole 12 may be preassembled, generally as shown in FIG. 3A. This would result in five preassembled sections. The corner sections would be secured together by taking a horizontal pole 20 from one corner section and connecting it to a horizontal pole of another corner section. Such connection may be accomplished in any suitable manner, such as by telescoping one end of one horizontal pole into an end of another pole where the ends are made of different diameter. Alternatively, the ends of two horizontal poles could be connected together by telescoping over or into a connecting piece. After the four corner sections are connected together the roof is joined by mounting each roof pole 24 into its respective hole in corner connector 16.

Figure 7:
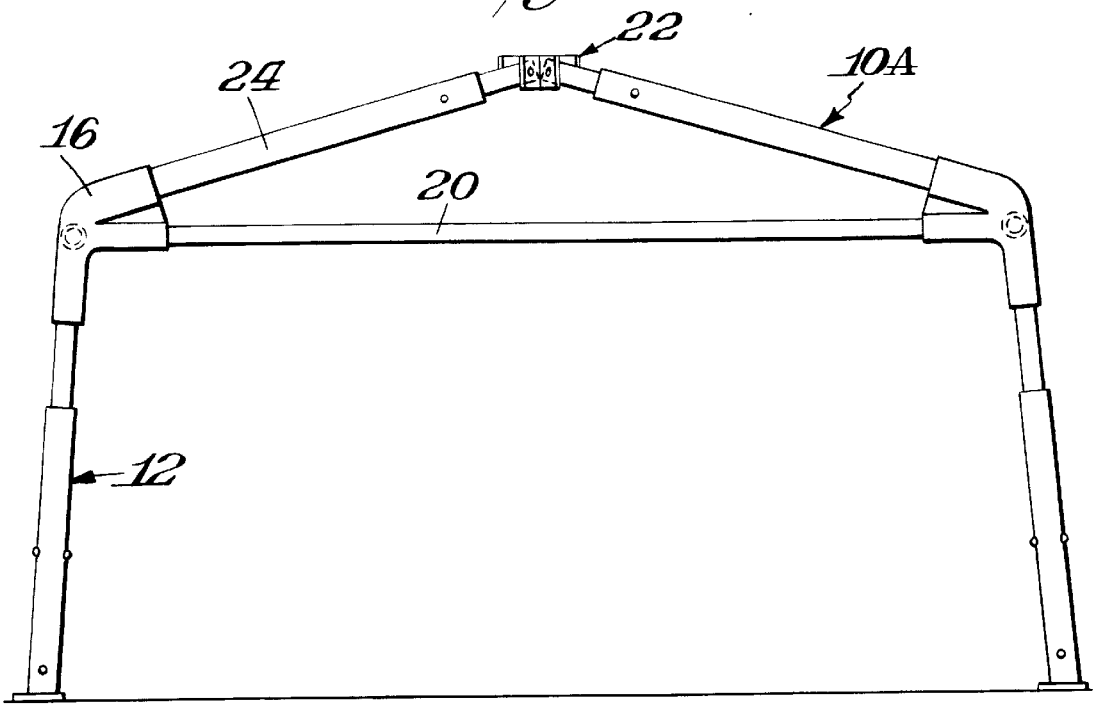
FIG. 7 is a side elevational view of a modified form of portable protective structure in accordance with this invention.

The concepts of this invention may be practiced with numerous variations within the spirit of this invention. For example, FIG. 2 illustrates the poles 12 to be vertical. FIG. 7, however, illustrates a variation wherein the structure 10A has a wigwam affect with, for example, inclined poles 12.

FIGS. 7–13 show a modified form of protective structure or frame in accordance with this invention. The primary differences in this embodiment are in the manner of connecting the roof poles to the corner connectors and in the manner of connecting the horizontal support poles to each other.

Figure 9:
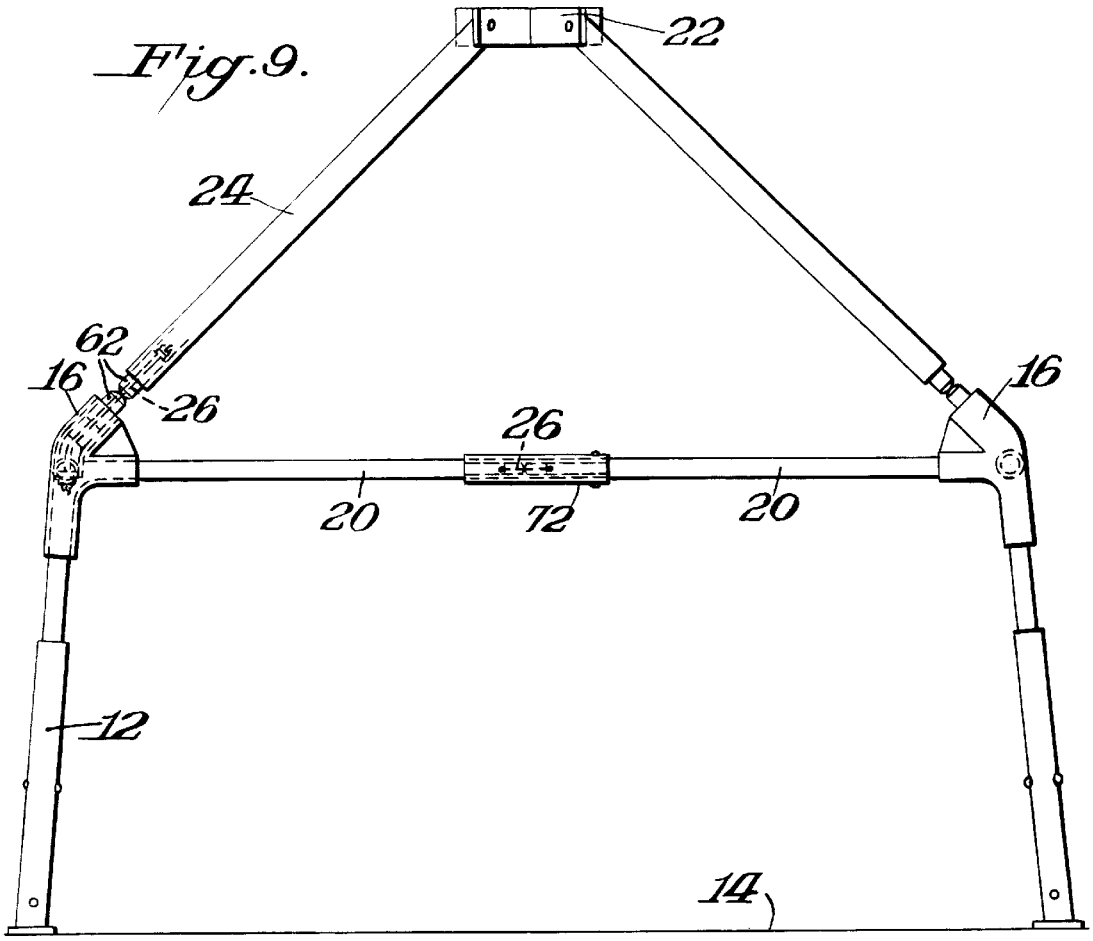
FIG. 9 is a side elevational view similar to FIG. 7 of yet another form of portable protective structure in accordance with this invention.
Figure 10:
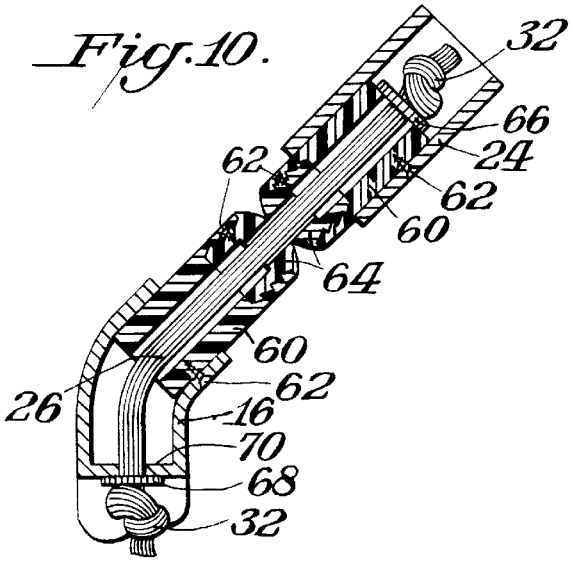
FIG. 10 is a cross-sectional view of a corner connector in the structure of FIG. 9.

FIGS. 9–10 best illustrate the features of the connection of the roof poles 24 to the corner connectors 16. As shown therein, the roof support poles 24 are not inserted directly into the corner connectors 16. Instead, a tubular insert 60 is inserted into each end of a respective roof support pole 24 and corner connector 16. The tubular inserts may be made of any suitable material such as aluminum. Each insert is secured in place by a suitable fastener 62. A cap 64 which could be made of any suitable material such as plastic is connected to the exposed outer end of each insert 60. Any manner of connection such as by screw threads and/or threaded fasteners 62 could be used for this purpose. A secure attachment of each roof support pole 24 to its corner connector 16 is achieved by means of a resilient cord 26 which extends through each set of tubular inserts 60 and cap 64 and through a washer 66 in roof support pole 24 at one end while extending through a washer 68 in corner connector 16 at its other end. Washer 66 abuts against the outer end of the tubular insert 60 within support pole 24 while washer 68 abuts against an end wall 70 in corner connector 16. Each end of the cord 26 is then knotted as indicated by the reference numeral 32 to prevent the end of the resilient cord 26 from slipping through the hole in its appropriate washer 66,68.

The use of inserts 60 is also advantageous in that it permits the openings or passageways in the corner connectors to have a different cross-section than the tubular poles. Thus, for example, the corner connector passageway may have a square cross-section with its insert 60 being of the same square cross-section, while the pole 24 may be of circular or other cross-section with its insert of the same cross-section. Alternatively, it is only necessary that the portion of the insert which is disposed within its respective corner connector or pole be of the same cross-section as its respective corner connector or pole. The remaining external portion of the insert could have a different cross-section. Thus, for example, a circular tubular pole could have an insert which is of circular cross-section in the portion of the insert disposed within the pole while the external portion is of square cross-section to complement the square cross-section of the insert in the corner connector. These examples of different geometric cross-sections are intended merely for exemplary purposes.

Figure 11:
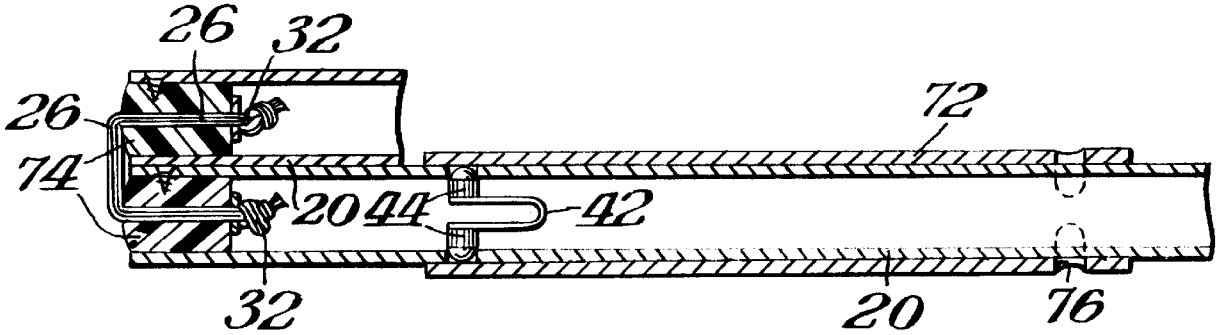
FIG. 11 is a side elevational view partly in section of portions of the horizontal support poles in the embodiment of FIG. 9 in the folded condition.

FIGS. 9 and 11–13 illustrate a modified manner of connecting the two horizontal support poles 20,20. In general, this is accomplished through the use of an outer sleeve 72 and a resilient cord 26. FIG. 11 illustrates two horizontal pole pieces 20 in the unconnected position during storage where the pieces would be side by side. As shown therein, a plug 74 made, for example, of a plastic material is inserted into the adjacent ends of each pole 20,20. Plug 74 may be secured in any suitable manner, such as by threaded fasteners. Each plug contains a passageway (which is preferably axially arranged) so that the passageways are aligned when the poles 20,20 are aligned with each other. A resilient cord 26 extends through each passageway. The free ends 32 of the cord 26 are knotted within the hollow pole 20. The threading of the cord 26 through the plugs 74 and the knotting of the ends 32 of the cord 26 could be accomplished before the plugs are inserted into the poles 20 and while the cord 26 is in a taut condition. If desired, a washer could also be provided between the free knotted end 32 of the cord and the inner end of the plug 74.

Figure 12:
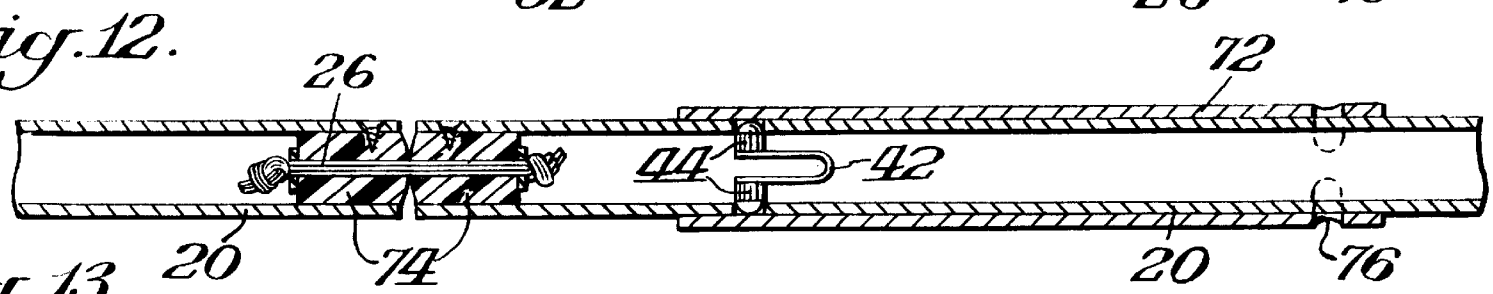
FIG. 12 is a view similar to FIG. 11 showing the horizontal support poles in the unfolded but not yet secured condition.
Figure 13:
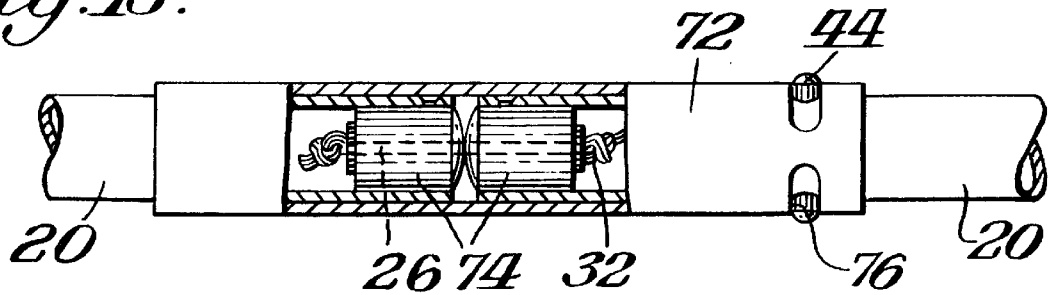
FIG. 13 is a view similar to FIG. 12 showing the horizontal poles in a secured condition.

When it is desired to assemble the two pole pieces together, the pole pieces are moved into alignment with each other as shown in FIG. 12. Initially, the sleeve 72 is in an inactive position such as shown in FIGS. 11 and 12. As also shown, a spring fastener 42 of the type previously described having pop buttons 44 is provided in one of the poles 20 with the pop buttons being located at holes in the pole 20. In the inactive position the sleeve 72 covers the holes in pole 20 thus maintaining the top buttons in a retracted position. Sleeve 72 is then slid toward the other pole piece 20 until cut outs 76 in the sleeve 72 are disposed at the holes in pole piece 20 thereby permitting the spring pop buttons 44 to extend through the holes and into the cut outs 76 so as to lock the sleeve 72 in place at a location where part of the sleeve covers the other pole piece. The pole pieces are maintained engaged with each other under the resilient action of the cord 26.

Figure 6:
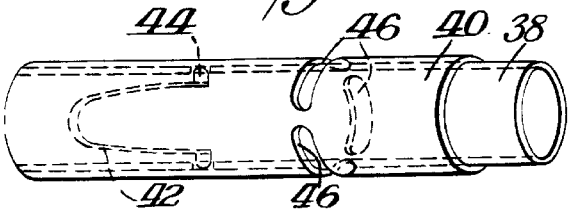
FIG. 6 is a fragmental side elevational view showing the locking structure using spring buttons and slots.

As previously noted a distinct advantage of the invention with respect to the snap button and slot arrangement shown in FIG. 6 is its ability to use tubing of circular cross-section. Where such type of fastening system is not used, the tubing for the pole may have other cross-sectional shapes such as the square shape for the roof poles shown in FIGS. 3A and 3B. It is thus to be understood that various cross-sectional shapes may be used for the various fastening systems within the broad concepts of this invention including circular and non-circular such as square, oval or rectangular. It is also to be understood that various materials may be used for making the components. The corner pieces and poles, for example, may be of molded plastic material or of conventional metal material. It is also to be understood that while specific fastening systems have been shown for each of the various types of vertical, horizontal and roofing poles either form of fastening system could be used for securing any of the poles. Thus, horizontal poles 20 could be made telescopic of circular cross-section by using the pop button/slot fasteners.

It is also to be understood that although the invention has been described in connection with a framework having four corners of square shape in plan view as shown for structure 10 in FIG. 1 or of rectangular plan view as shown for structure 10A, other shapes may be used such as triangular, pentagon, hexagon, etc. within the spirit of this invention which utilize the fastening systems described herein.

Among the advantages of the invention are that the use of spring clips and resilient cords provides a force to pull the components together at the corner pieces. The use of the pop buttons and slots eliminates the need for pre-aligning the telescopic components and permits less costly circular cross section poles to be used.

It should be appreciated that the invention thus provides a manner of readily assembling a framework for a portable protective structure onto which suitable cover material may be attached in any known manner over the roof alone or over the roof and partially down the sides or over the roof and completely down the sides.

It is to be understood that various features described with respect to various embodiments and with respect to, for example, the securing of various components together may be used in other embodiments and for securing other components together. Thus, for example, the manner of connection of the two horizontal pole pieces may be used for securing the two vertical pole pieces. Similarly, the manner of attaching the roof eave support poles to the corner connector may be used for attaching the horizontal poles and/or the vertical poles to the corner connector. Such modifications and variations may be made within the spirit of this invention.

What is claimed is:

1. A portable protective structure having a plurality of corners, a corner connector at each of said corners, said corner connector including a vertically downwardly disposed passageway and an upwardly angularly disposed passageway and two interconnected horizontal passageways, a vertical support pole assembly at each of said corners mounted in said vertically downwardly disposed passageway, a horizontal support pole assembly mounted in each of said horizontal passageways of said corner connector, a roof assembly said roof assembly comprising a roof peak and a plurality of eaves and a cover, each of said eaves being connected to said roof peak and being inserted into said upward angularly disposed passageway of a respective one of said corner connectors, said cover being mounted over said eaves, said horizontal support pole assemblies being connected to each other at each of said corner connectors by means of a resilient cord extending through said two horizontal interconnected passageways with each end of said cord being located in a respective one of said horizontal support pole assemblies, a fastener in each of said horizontal support pole assemblies, a free end of said cord being anchored to said fastener to urge said horizontal pole assemblies into said horizontal interconnected passageways, each of said horizontal pole assemblies comprises a plurality of tubular poles, said fastener being a spring clip mounted in each end of said horizontal support pole assemblies resiliently held against the inner surface of one said tubular pole, and said free end of said cord being attached to said spring clip at a location outwardly of said corner connector.

2. The structure of claim 1 wherein said spring clip has a plurality of spaced spring arms, and said spring arms being disposed against the inner surface of said tubular pole of said horizontal pole assembly.

3. The structure of claim 1 wherein each of said vertical support pole assemblies comprises an inner tubular pole telescopically mounted in an outer tubular pole, at least one lock member in said inner tubular pole, at least one receiving member in said outer tubular pole, and said lock member being engaged in said receiving member.

4. The structure of claim 3 wherein said at least one lock member is a pop button mounted on the end of a U-shaped spring arm.

5. The structure of claim 4 wherein said inner tubular pole and said outer tubular pole are of circular cross-section, and said at least one receiving member comprising a plurality of co-arcuate slots in said outer pole member into which a respective pop button would be inserted.

6. The structure of claim 5 wherein said roof peak comprises a plurality of sockets corresponding to the number of said eaves, and each of said eaves mounted in a respective socket in a manner which permits free rotation of said eave.

7. The structure of claim 6 wherein each of said sockets is in the form of a pair of walls having aligned holes, and a fastener inserted through said holes and connected to said eaves to permit said free rotation.

8. The structure of claim 7 wherein said fastener is a U-shaped spring arm having a pop button at each end thereof for insertion through a hole in said eave and then into a respective one of said holes in said walls.

9. The structure of claim 7 wherein said fastener is a bolt extending through aligned holes in said eave and through said aligned hole of said walls.

10. The structure of claim 1 wherein said roof peak comprises a plurality of sockets corresponding to the number of said eaves, and each of said eaves mounted in a respective socket in a manner which permits free rotation of said eave.

11. The structure of claim 10 wherein each of said sockets is in the form of a pair of walls having aligned holes, and a fastener inserted through said holes and connected to said eaves to permit said free rotation.

12. The structure of claim 1 wherein each of said eaves includes a tubular insert at its end disposed toward said corner connector and in alignment with a second tubular connector mounted in said corner connector, a resilient cord extending through said inserts, and each end of said cord being anchored outwardly of its respective said insert.

13. The structure of claim 1 wherein each of said horizontal pole assemblies comprises a plurality of tubular poles, a sleeve slidably mounted over said tubular poles, a plug in each end of said tubular poles where said tubular poles are in alignment with each other, a resilient cord extending through said plugs, said cord having free ends anchored within their respective tubular poles, and said sleeve being slidably mounted over the junction of said tubular poles.

14. The structure of claim 13 wherein one of said tubular poles includes a spring fastener mounted within said tubular pole, said spring fastener having a U-shaped spring arm with a pop button mounted at each end of said spring arm located at a hole in said tubular pole, and said sleeve having cut-outs located for positioning over said pop buttons whereby said pop buttons may enter said cutouts to lock said sleeve in place.

15. A portable protective structure having a plurality of corners, a corner connector at each of said corners, said corner connector including a vertically downwardly disposed passageway and an upwardly angularly disposed passageway and two interconnected horizontal passageways, a vertical support pole assembly at each of said corners mounted in said vertically downwardly disposed passageway, a horizontal support pole assembly mounted in each of said horizontal passageways of said corner connector, a roof assembly, said roof assembly comprising a roof peak and a plurality of eaves and a cover, each of said eaves being connected to said roof piece and inserted into said upwardly angularly disposed passageway of a respective one of said corner connectors, said cover being mounted over said eaves, at least one of said vertical support pole assembly and said horizontal support pole assembly including an inner tubular member of circular cross section telescopically received in an outer tubular member of circular cross-section, said inner tubular member being inserted into a respective passageway of said corner connector, said outer tubular member having a plurality of circumferential aligned elongated non-circular arcuate slots, and said inner tubular member having at least one locking member for being received in a respective one of said slots.

16. The structure of claim 15 wherein said locking member comprises a pop button at each end of a U-shaped spring arm, and said inner tubular member having a hole through which a respective pop button extends for insertion into a respective one of said slots.

17. The structure of claim 16 wherein said plurality of arcuate slots comprises at least three slots.

18. The structure of claim 16 wherein said vertical support pole assembly comprises said inner tubular member and said outer tubular member.

19. The structure of claim 18 wherein said roof peak comprises a plurality of sockets corresponding to the number of said eaves, and each of said eaves mounted in a respective socket in a manner which permits free rotation of said eave.

20. The structure of claim 19 wherein each of said sockets is in the form of a pair of walls having aligned holes, and a fastener inserted through said holes and connected to said eaves to permit said free rotation.

21. The structure of claim 15 wherein each of said eaves includes a tubular insert at its end disposed toward said corner connector and in alignment with a second tubular connector mounted in said corner connector, a resilient cord extending through said inserts, and each end of said cord being anchored outwardly of its respective said insert.

22. The structure of claim 15 wherein each of said horizontal pole assemblies comprises a plurality of tubular poles, a sleeve slidably mounted over said tubular poles, a plug in each end of said tubular poles where said tubular poles are in alignment with each other, a resilient cord extending through said plugs, said cord having free ends anchored within their respective tubular poles, and said sleeve being slidably mounted over the junction of said tubular poles.

23. The structure of claim 22 wherein one of said tubular poles includes a spring fastener mounted within said tubular pole, said spring fastener having a U-shaped spring arm with a pop button mounted at each end of said spring arm located at a hole in said tubular pole, and said sleeve having cut-outs located for positioning over said pop buttons whereby said pop buttons may enter said cutouts to lock said sleeve in place.

24. A portable protective structure having a plurality of corners, a corner connector at each of said corners, said corner connector including a vertically downwardly disposed passageway and an upwardly angularly disposed passageway and two interconnected horizontal passageways, a vertical support pole assembly at each of said corners mounted in said vertically downwardly disposed passageway, a horizontal support pole assembly mounted in each of said horizontal passageways of said corner connector, a roof assembly, said roof assembly comprising a roof peak and a plurality of eaves and a cover, each of said eaves being connected to said roof piece and inserted into said upwardly angularly disposed passageway of a respective one of said corner connectors, said cover being mounted over said eaves, said roof peak comprising a plurality of sockets corresponding to the number of said corners, each of said sockets being in the form of a pair of walls having aligned holes, and each of said eaves being mounted to a respective one of said sockets by a fastener assembly which permits free rotation of said eaves whereby said peak and said eaves may comprise a preassembly having said eaves disposed against each other while connected to said peak, wherein each of said eaves is pivotally connected to said walls by a U-shaped spring arm mounted within said eave, a pop button at each end of said spring arm, and each said pop button extending through a hole in said eave and into a respective hole of said wall.

25. The structure of claim 24 wherein each of said eaves includes a tubular insert at its end disposed toward said corner connector and in alignment with a second tubular connector mounted in said corner connector, a resilient cord extending through said inserts, and each end of said cord being anchored outwardly of its respective said insert.

26. A method of assembling a portable protective structure comprising forming a preassembly of a plurality of eaves pivotally connected to a roof peak with the eaves being disposed against each other while connected to the peak, preassembling a plurality of corner assemblies by inserting a vertical pole assembly into a vertically disposed passageway of a corner connector with the corner connector having a pair of communicating horizontal passage-ways and disposing a horizontal support pole assembly member into a respective one of said horizontal passageways, mounting the assemblies together, and mounting a cover over the eaves and roof peak preassembly, wherein the outer tubular member of each vertical support pole assembly is of circular cross-section and includes a plurality of aligned arcuate slots and the inner tubular member includes a U-shaped spring arm having a pop button at each end extending through a respective hole in the inner tubular member, and securing the inner tubular member to the outer tubular member by insertion of a pop button into a respective slot.

27. The method of claim 26 wherein each vertical pole assembly includes an inner pole telescopically mounted into an outer pole, and extending the inner pole from the outer pole after the assemblies have been mounted together to elevate the height of the structure.

28. The method of claim 26 wherein the horizontal members of adjacent horizontal support pole assemblies are connected together by inserting one horizontal pole into a connecting piece or a respective other horizontal pole.

* * * * *